United States Patent [19]

Nugent

[11] 4,124,044

[45] Nov. 7, 1978

[54] VENTED PROTECTIVE SHIELD FOR CAPILLARY PIPETTE

[75] Inventor: Edward L. Nugent, North Caldwell, N.J.

[73] Assignee: Becton, Dickinson and Company, Rutherford, N.J.

[21] Appl. No.: 855,556

[22] Filed: Nov. 29, 1977

[51] Int. Cl.[2] ..... B65B 3/04

[52] U.S. Cl. ..... 141/98; 141/22; 141/115; 73/425.4 P

[58] Field of Search ..... 141/1-12, 141/115-127, 18-29, 392; 73/425.4 P

[56] References Cited

FOREIGN PATENT DOCUMENTS 103,971 3/1926 Austria ..... 141/22

*Primary Examiner*—Houston S. Bell, Jr.

*Attorney, Agent, or Firm*—Kane, Dalsimer, Kane, Sullivan and Kurucz

[57] ABSTRACT

A vented protective shield for a capillary pipette which may also serve as an overflow chamber for the pipette assembly. The assembly includes a pipette which is attached to a tubular holder. Both ends of the holder are adapted for frictionally engaging the vented shield. When attached to the end of the holder which includes the pipette, the shield serves as a protective device. When attached to the opposite end of the holder, it serves as an overflow chamber which prevents spillage of the sample as it is being diluted.

4 Claims, 5 Drawing Figures

VENTED PROTECTIVE SHIELD FOR CAPILLARY PIPETTE

BACKGROUND OF THE INVENTION

Micro-pipetting of samples of fluid such as blood by use of small volume capillary tubes is a highly developed and advanced state of art. It is conventional in the known system to provide a shield for the pipette when it is not in use as a protective device. The shield is removably positioned on the pipette assembly so that it can be removed from the pipette when the pipette is introduced to the sample producing source for pipetting activity. Throughout the years, the shield has been used for various other purposes. For example, the shield is often used as a puncturing device since it has a closed protective end and forms a cap for the pipette. The closed end can be used to puncture diaphragms on reservoirs containing diluents and other types of medicaments to be used with the sample collected in the pipette.

Micro-pipettes with protective shields are known in many diverse fields. One particular area of common use is in the medical field where small samples of fluid such as precise micro-quantities of blood are collected and tested. Naturally other pipetting fields also require the use of a protective shield to guard the pipette when it is not being used. An example of a prior art patent in this area relating to general pipetting procedure and where a protective shield is employed is Roach U.S. Pat. No. 3,494,201 issued on Feb. 10, 1970. In contrast, examples of the type of pipette assembly under consideration which pertain to the medical profession are disclosed in U.S. Pat. Nos. 2,965,255 to Gerarde on Dec. 20, 1960; 3,433,712 to Gerarde on Mar. 18, 1969; 3,518,804 to Gerarde on July 7, 1970; and 3,779,083 to Ayres Et Al on Dec. 18, 1973. These references disclose the general pipetting concept and various types of known protective shields used with the pipette.

During the procedure of obtaining samples of fluid and diluting them with reagents contained within a resilient and compressible reservoir, spillage of the diluted sample can easily occur. Conventional pipette assemblies typicaly include three basic parts: a holder, a pipette mounted on one end of the holder, and a small overflow chamber on the other end of the holder. The holder is hollow so as to establish fluid communication between the pipette and overflow chamber.

In operation, a blood sample is first taken by touching the tip of the pipette to a supply of blood, commonly the patient's finger. The pipette fills by capillary action. A resilient reservoir containing diluent and reagents is squeezed slightly, and the pipette is inserted within the reservoir. When pressure is released on the reservoir, negative pressure draws the blood sample into the diluent. The reservoir is then squeezed gently several times to rinse the capillary bore, forcing diluent into, but not out of, the overflow chamber. Pressure is released each time to return the mixture to the diluent.

It is during this last step that great care must be taken in not squeezing the reservoir too hard. If overflow occurs, not only is there a loss of specimen sample, but there is also a risk of contaminating the fingers with the diluent solution. The solution often contains toxic compounds such as hydrazoic acid, and it is undesirable to have such chemicals contact the skin.

SUMMARY OF THE INVENTION

With the above background in mind, it is among the primary objectives of the present invention to provide a protective shield for a capillary pipette in general and, in particular, one which is adapted for use as a protective shield for a pipette assembly used for collecting and testing micro-amounts of body fluids such as blood. The shield is designed to be removably mounted on a pipette assembly to protect the micro-pipette when not in use. Furthermore, the shield is designed to facilitate ease of puncture through a diaphragm while including control means to limit the amount of extension through the diaphragm after puncture to reduce the danger of contamination of the end of the outer surface of the shield. Additionally, the shield has a configuration which facilitates nesting of the shield to provide ease of separation when the shields are individually assembled with a pipette assembly as a protective structure. This is particularly true when a stack of shields in nested condition are positioned on an automated assembly mechanism for individual removal and coupling with an individual pipette assembly. The shield further includes one or more vents which enable it to be used an an overflow chamber in addition to a protective device.

The non-locking feature of the present design facilitates automatic feeding since no physical force is necessary to remove them from nested interengagement since they will separate by the force of gravity alone. For a description of this feature in greater detail, reference should be made to commonly assigned application Ser. No. 818,617, filed July 25, 1977.

Furthermore, the material of the present shield is of a type having natural lubricity which facilitates puncturing of a sealed container to reach the contents of the container. For example, the container can be a sealed reservoir containing a medicament or diluent to be combined with a blood sample.

It should be kept in mind that the outer configuration of the shield with the integral stop formed by the shoulder prevents the shield from being inserted too far through the diaphragm of the sealed container. This eliminates the danger of the shield becoming stuck or wedged into the diaphragm or possible contamination of the end of the shield.

The vents which are provided on the shield allow it to be used as an overflow chamber during the dilution of the specimen of blood or other body fluid which is collected in the pipette. The pipette assembly with which the vented shield is used comprises a holder with a pipette mounted to one end, and which has both ends adapted for attachment of the shield. The shield is positioned over the pipette when the device is not in use, and serves to protect it from damage. When the assembly is needed for specimen sampling, the shield is first used to puncture the diaphragm of a reservoir which contains diluent or other chemicals. It is then removed from the pipette end of the holder while the fluid sample is taken. Once the sample accumulates in the pipette by means of capillary action, the reservoir is squeezed, and the pipette is inserted within the reservoir. The assembly is seated securely in the reservoir neck so as to form a substantially air-tight seal, and the pressure on the reservoir is released. Negative pressure draws the blood into the diluent. At this point, the vented shield is secured to the end of the holder opposite the pipette, and the reservoir is squeezed several more times to thoroughly rinse the capillary bore. The risk of spillage is greatly reduced as the mixture must reach the height of the vents to overflow. This height is considerably greater than the height of the holder itself when held vertically.

The shield of the present invention consists of a hollow tubular member with a conical tip smoothly extending into a tapered cylindrical portion terminating in a vented shoulder. The shoulder extends into a wider cylindrical portion terminating in an open end surrounded by an annular flange. The interior of the body is hollow and the inner surface has a configuration substantially conforming to the outer surface of the shield. The outside and inside configurations of each shield is designed so that the shields may be stacked but will not lock together. The open end of the shield is designed to fit over either end of a pipette assembly with which it is used to provide the aforementioned advantages. The vents may be located anywhere on the shield so long as the overflow chamber is sufficiently extended.

With the above objectives among others in mind, reference is made to the accompanying drawings.

DETAILED DESCRIPTION OF THE INVENTION

While the shield of the present invention is designed to be used with many different types of micro-pipette assemblies, such as those depicted and described in the above referenced patents, in the depicted embodiment it is used in a conventional type of micro-pipetting system commonly used to take a small sample of blood from a patient and transfer the blood to a reservoir containing a diluent, and other medicaments if desired, for testing and evaluation purposes.

Shield 20 is formed of an inexpensive material lending itself to disposability such as a common plastic. It is also desirable to use a material which has natural lubricity to facilitate use of portions of the shield 20 as a puncturing device by making it easier to insert and remove the shield from the punctured article. An example of an acceptable material for this purpose is polypropylene 6513 manufactured by Hercules Inc. 380 Madison Avenue of New York, New York.

Figure 1:
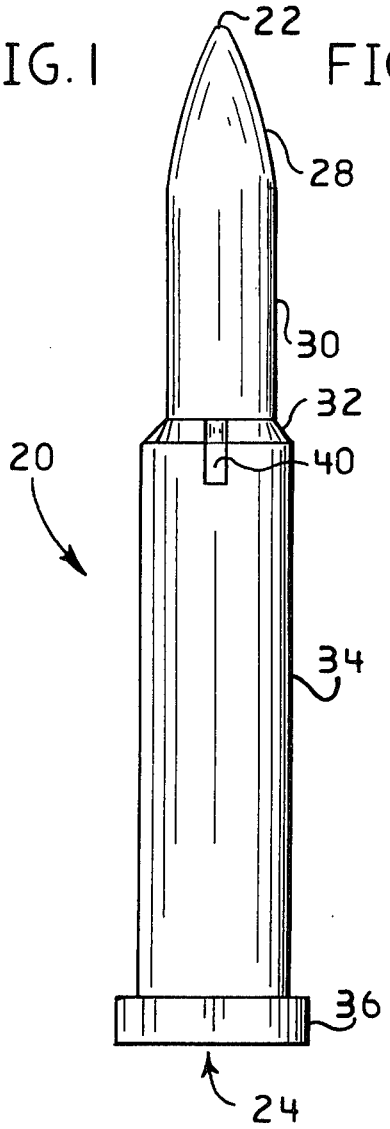
FIG. 1 is a side elevation view of a shield of the invention.
Figure 3:
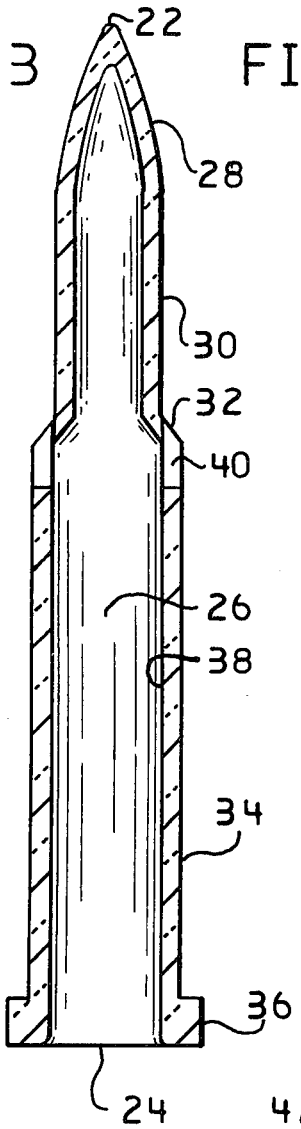
FIG. 3 is a sectional side elevation view thereof taken along the plane of line 3—3 in FIG. 2.
Figure 2:
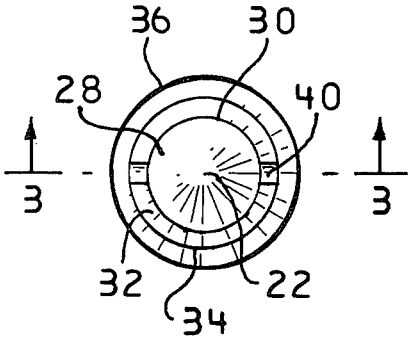
FIG. 2 is a top plan view thereof.

Referring to FIGS. 1–3, shield 20 is generally tubular in configuration with a closed forward tip 22 and an open rear end 24 permitting access to chamber 26 in the hollow interior of the shield. Tip 22 is pointed on its outer surface and forms the apex of a conical tip portion 28. The conical tip portion extends into an integral cylindrical portion 30 which terminates in a fustroconically shaped outwardly extending shoulder 32. The shoulder has a rear cylindrical portion 34 extending therefrom which terminates in open end 24. The open end 24 is surrounded by a flange or rim 36. The inner surface 38 of the shield corresponds generally in configuration to the outer surface of the shield as described above. One or more vents 40 are provided on the shield, and are located in the shoulder portion 32.

It has been found to be advantageous to apply a slight taper to the inner and outer surfaces of the cylindrical portions 30 and 34 of the shield, such as up to 15° in a direction tapering inwardly toward the tip 22. Thus, open end 24 is wider than the opposite closed end 22. This facilitates insertion and removal of the shield on a pipette assembly and also assists in the stacking and unstacking of shield 20 as described in copending application Ser. No. 818,617 filed July 25, 1977.

Tip 22 is pointed to facilitate puncturing of a reservoir diaphragm with the shield and the natural lubricity of the material of shield 20 assists in this puncturing and removal action.

Figure 4:
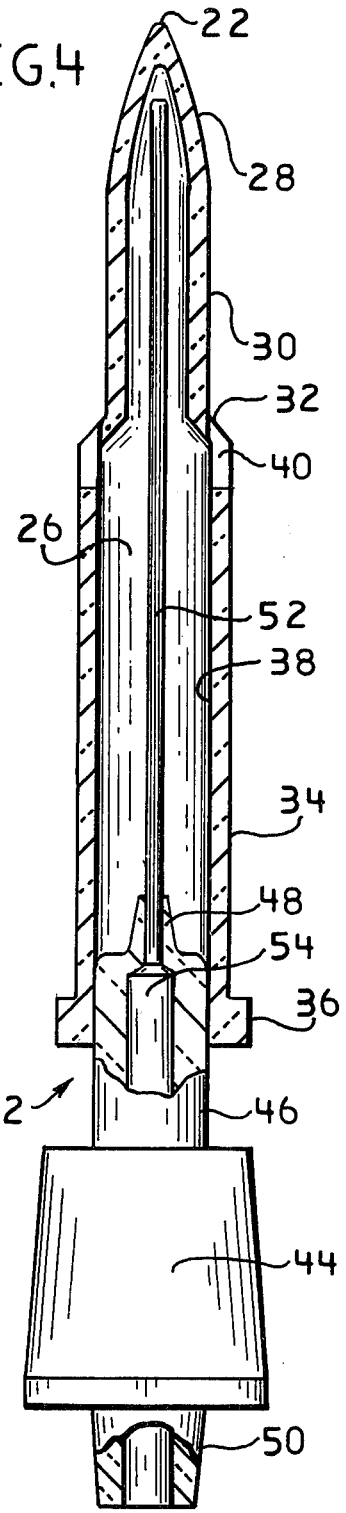
FIG. 4 is a partially sectional side elevation view of the shield as used as a protective device for a pipette assembly.
Figure 5:
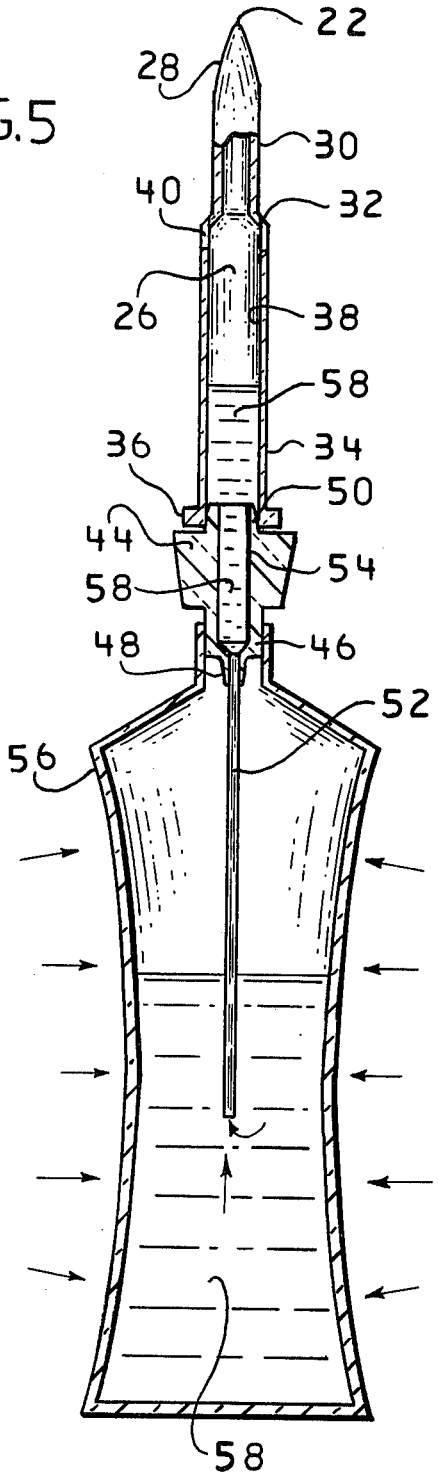
FIG. 5 is a sectional elevation view of the shield as used as an overflow chamber when the pipette is inserted within a flexible reservoir, and the reservoir is subsequently squeezed.

The inner surface of open end 24 of the shield is designed to frictionally engage either hub receiving surface 46 or 50 of a pipette assembly 42. The pipette assembly includes a holder 44 having the two receiving hubs 46 and 50 on either side. The first hub 46 includes a hub section 48 for accomodation of a pipette 52. A conduit 54 is provided through the pipette assembly, and connects the pipette 52 with hub 50, which also serves as an overflow chamber. As shown in FIG. 4, the shield engaged on hub 46 serves as a protective device for the pipette. FIG. 5 shows the shield as mounted upon hub/overflow chamber 50, thereby serving as an extension of this overflow chamber.

The operation of the pipette assembly and novel shield shall now be described. In storage, the apparatus is assembled as shown in FIG. 4 with the shield protecting the pipette from damage. When a body fluid is to be taken, the apparatus as shown in FIG. 4 is used to puncture the diaphragm (not shown) of a reservoir 56. The pointed tip 22 of the shield is particularly suitable for this purpose. The shield is then removed from the pipette assembly and is temporarily set aside along with the reservoir.

If a blood sample is to be taken, the assembly is held almost horizontally, touching the tip of the pipette to the blood. The pipette will fill by capillary action. When filling is complete, it will stop automatically when the blood reaches the end of the capillary bore in the neck of the pipette.

The reservoir is then squeezed to force out some air, but no liquid 58 should be expelled. Pressure is maintained on the reservoir as the pipette assembly is seated securely in the reservoir neck, the pipette extending into the reservoir. The opening of the overflow chamber 50 is covered as the assembly is seated. Pressure is then released from the reservoir, and the overflow chamber opening is uncovered. Negative pressure draws the blood into the diluent.

At this point, the vented shield is fitted over the overflow chamber, its inner surface frictionally engaging the outer surface of the chamber 50. The reservoir is squeezed several times to rinse the capillary bore, forcing diluent into, but not out of, the extended overflow chamber defined by the volume of the shield between the top of overflow chamber 50 and the vents 40. There is clearly less chance of spillage than if the conventional apparatus, includng only the overflow chamber 50, is used.

After the blood is thoroughly mixed, the shield is removed and the pipette assembly is reseated in the reservoir in the reverse position. The apparatus can then serve as a dropper. The mixture can then be tested by the medical staff.

It can be seen that a highly advantageous assembly is provided which significantly reduces the possibility of spillage of the mixture while the sample is diluted. Other embodiments of the invention are also possible without departing from the spirit of the invention. The shield may have a different shape so as to accommodate alternative assemblies, and the vents may be located in any number of locations. The above description and drawings are therefore intended to be illustrative and not limiting, and the scope of the invention to be determined in accordance with the appended claims.

What is claimed is:

1. A shield adapted for use in protecting a capillary pipette of a pipette assembly, the assembly including a housing having a passage therethrough, means for removably receiving an open end of a shield near both ends of the passage, the capillary pipette extending from one end of the passage and in fluid communication therewith, the shield comprising:

a hollow tubular body having at least one open end, the open end having means thereon for removably mounting the shield upon the receiving means of the housing, and at least one vent located on the body of the shield between the open end and the other end thereof, whereby when the shield is mounted near one end of the passage within the assembly housing, it protects the capillary pipette, and when mounted near the other end of the passage, it serves as an overflow chamber in fluid communication with the passage.

2. A shield as described in claim 1 further comprising a shoulder portion on the body of the tube, the shoulder portion being vented.

3. A shield as described in claim 1 wherein one end of the shield is closed and pointed so as to facilitate use of the shield as a puncturing device.

4. A shield as described in claim 1 wherein the open end is adapted to be removably mounted to a hub portion on the assembly housing which serves as an overflow chamber in fluid communication with the passage, the shield serving as an extension of the overflow chamber.

* * * * *